US011158959B2

(12) United States Patent
Masuda et al.

(10) Patent No.: US 11,158,959 B2
(45) Date of Patent: Oct. 26, 2021

(54) TERMINAL CRIMPING METHOD AND TERMINAL CRIMPING STRUCTURE

(71) Applicant: YAZAKI CORPORATION, Tokyo (JP)

(72) Inventors: Satoki Masuda, Shizuoka (JP); Yoshinao Sato, Shizuoka (JP); Takeo Ida, Shizuoka (JP); Junpei Hayashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 272 days.

(21) Appl. No.: 16/386,093

(22) Filed: Apr. 16, 2019

(65) Prior Publication Data

US 2019/0356061 A1 Nov. 21, 2019

(30) Foreign Application Priority Data

May 21, 2018 (JP) ..... JP2018-097223

(51) Int. Cl.
*H01R 4/18* (2006.01)
*H01R 43/048* (2006.01)
*H01R 43/058* (2006.01)

(52) U.S. Cl.
CPC ..... *H01R 4/18* (2013.01); *H01R 43/048* (2013.01); *H01R 43/058* (2013.01); *Y10T 29/49185* (2015.01)

(58) Field of Classification Search
CPC ..... H01R 4/18; H01R 4/183; H01R 4/188; H01R 4/20; H01R 4/203; H01R 4/206; H01R 9/0518; H01R 43/048; H01R 43/058; Y10T 29/49174; Y10T 29/49181; Y10T 29/49183; Y10T 29/49185; Y10T 29/53235
See application file for complete search history.

(56) References Cited

U.S. PATENT DOCUMENTS 6,137,056 A * 10/2000 Miyazaki ..... H01R 9/0524 174/78
6,398,563 B1 * 6/2002 Kanagawa ..... H01R 9/0518 439/587
6,568,075 B1 5/2003 Yamakawa
2001/0002508 A1 6/2001 Yamakawa
2017/0214153 A1 * 7/2017 Hamada ..... H01R 9/0518

FOREIGN PATENT DOCUMENTS

JP 2000-21543 A 1/2000
JP 2011-171057 A 9/2011
JP 2017-147419 A1 8/2017
WO 2011/102536 A1 8/2011

* cited by examiner

*Primary Examiner* — Peter Dungba Vo
*Assistant Examiner* — Joshua D Anderson
(74) *Attorney, Agent, or Firm* — Kenealy Vaidya LLP

(57) ABSTRACT

A terminal crimping method includes covering an end portion of an electric wire with a fixing cylinder portion of a terminal including a flange portion which protrudes toward an outer periphery and which has at least one notch along a radial direction, caulking and crimping the fixing cylinder portion by a pair of dies including pressing projections, and caulking the fixing cylinder portion by the pressing projections to form crimp recess portions, in the caulking and crimping the fixing cylinder portion.

10 Claims, 7 Drawing Sheets

TERMINAL CRIMPING METHOD AND TERMINAL CRIMPING STRUCTURE

CROSS REFERENCE TO RELATED APPLICATIONS

This application claims priority from Japanese Patent Application No. 2018-097223 filed on May 21, 2018, the entire contents of which are incorporated herein by reference.

BACKGROUND OF THE INVENTION

Field of the Invention

The present invention relates to a terminal crimping method and a terminal crimping structure.

Description of Related Art

As a technology for crimping a terminal to an electric wire, for example, there has been known a technique of caulking and crimping a cylindrical terminal into which an electric wire is inserted to have a hexagonal cross section by abutting a pair of dies including a recess portion having a shape, in which a hexagonal cross section is bisected, on each other (see, for example, the patent document 1: JP-A-2000-21543 and the patent document 2: JP-A-2011-171057).

[Patent Document 1] JP-A-2000-21543

[Patent Document 2] JP-A-2011-171057

According to a related art, pressing projections provided at opposing places of each die bite into the terminal to increase a crimping force with an electric wire. However, when a flange portion is formed on a biting portion of a terminal, a great tensile force is applied between the biting portion of the pressing projection and the highly rigid flange portion, damage such as cracking is caused, and as a result, there is concern of deterioration in performance and quality.

SUMMARY

One or more embodiments provide a terminal crimping method and a terminal crimping structure capable of firmly caulking and crimping a terminal to an electric wire while reducing damage such as cracking.

In order to achieve the above-mentioned object, a terminal crimping method according to the invention is characterized in the following (1) to (4).

In an aspect (1), a terminal crimping method includes covering an end portion of an electric wire with a fixing cylinder portion of a terminal including a flange portion which protrudes toward an outer periphery and which has at least one notch along a radial direction, caulking and crimping the fixing cylinder portion by a pair of dies including pressing projections, and caulking the fixing cylinder portion by the pressing projections to form crimp recess portions, in the caulking and crimping the fixing cylinder portion.

In an aspect (2), the terminal crimping method according to claim 1, further includes disposing the notch in a vicinity of the pressing projection.

In an aspect (3), the flange portion includes a plurality of the notches which are positioned with intervals in a circumferential direction of the flange portion.

In an aspect (4), the electric wire includes a shield conductor formed of a braid. The terminal includes a crimp cylinder portion through which the electric wire is inserted, and a fixing member having the fixing cylinder portion. The fixing cylinder portion is caulked by the dies, in a state that the shield conductor which is folded back is disposed between the crimp cylinder portion and the fixing cylinder portion of the fixing member.

According to the aspect (1), when a fixing cylinder portion is caulked by dies, by making pressing projections to bite into the fixing cylinder portion to form crimping recess portions, a crimping force to an electric wire can be increased. At this time, when a highly rigid flange portion is formed near the fixing cylinder portion which is a caulked portion of a terminal, a great tensile force is applied between a portion where the pressing projections bite into the fixing cylinder portion and the flange portion. However, since at least one notch along a radial direction is provided on the flange portion, the notch is deformed to be opened so that the tensile force generated while caulking is absorbed and reduced. Accordingly, it is possible to reduce damage such as cracking in the fixing cylinder portion and to crimp the terminal to the electric wire with high crimping force while securing good performance and quality.

According to the aspect (2), it is possible to enhance the effect of reducing the tensile force generated while caulking by the notch.

According to the aspect (3), it is possible to enhance the effect of reducing the tensile force generated while caulking by the notch in a circumferential direction.

According to the aspect (4), it is possible to reduce damage to the fixing cylinder portion of a fixing member and obtain a good shielding effect.

In order to achieve the above object, a terminal crimping structure according to the invention is characterized in the following (5) to (8).

In an aspect (5), a terminal crimping structure includes an electric wire and a terminal. The terminal includes a fixing cylinder portion of the terminal including a flange portion which protrudes toward an outer periphery and which covers an end portion of the electric wire. The fixing cylinder portion is caulked and crimped. The flange portion has at least one notch along a radial direction. Crimp recess portions are formed in the fixing cylinder portion which is calked.

In an aspect (6), the crimp recess portion is formed in a vicinity of the notch.

In an aspect (7), the flange portion includes a plurality of the notches which are positioned with intervals in a circumferential direction of the flange portion.

In an aspect (8), the electric wire includes a shield conductor formed of a braid. The terminal includes a crimp cylinder portion through which the electric wire is inserted, and a fixing member having the fixing cylinder portion. The fixing cylinder portion is caulked, in a state that the shield conductor which is folded back is disposed between the crimp cylinder portion and the fixing cylinder portion of the fixing member.

According to the aspect (5), crimp recess portions are formed and a crimping force in a caulked portion is increased. Since at least one notch is provided in a flange portion along a radial direction, when the crimp recess portions are formed, the notch is deformed to be opened so that a tensile force generated while caulking is absorbed and reduced.

Accordingly, it is possible to provide a crimping structure in which a terminal is crimped to an electric wire with high crimping force, and further, good performance and quality are secured without damage such as cracking in the fixing cylinder portion.

According to the aspect (6), it is possible to provide a crimping structure with good performance and quality in which the tensile force generated when forming the crimp recess portion is reduced by the plurality of notches.

According to the aspect (7), it is possible to provide a crimping structure with good performance and quality in which the tensile force generated when forming the crimp recess portion is reduced in a circumferential direction by the plurality of notches.

According to the aspect (8), it is possible to provide a crimping structure in which damage to the fixing cylinder portion of the fixing member is reduced and a satisfactory shielding effect is obtained.

According to one or more embodiments, it is possible to provide a terminal crimping method and a terminal crimping structure capable of firmly caulking and crimping a terminal to an electric wire while reducing damage such as cracking.

The invention has been described above briefly. The details of the invention will become more apparent by reading through a mode for carrying out the invention described below with reference to the accompanying drawings.

BRIEF DESCRIPTION OF THE DRAWINGS

FIGS. 7A and 7B are views for explaining a die for crimping a terminal to an end portion of an electric wire, wherein FIG. 7A is a perspective view of the die, and FIG. 7B is a schematic configuration diagram of a crimping place of the electric wire by a pair of dies.

DETAILED DESCRIPTION

Hereinafter, a terminal crimping method and a terminal crimping structure according to an embodiment will be described with reference to the drawings.

Figure 1:
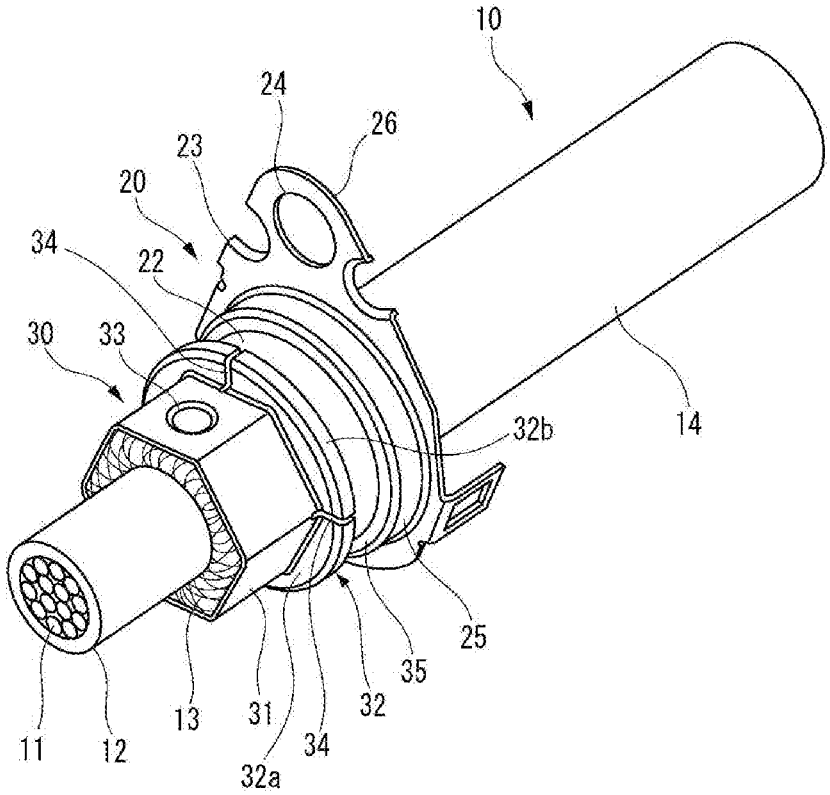
FIG. 1 is a perspective view of an end portion of an electric wire to which a terminal is crimped for explaining a terminal crimping structure according to an embodiment.
Figure 2:
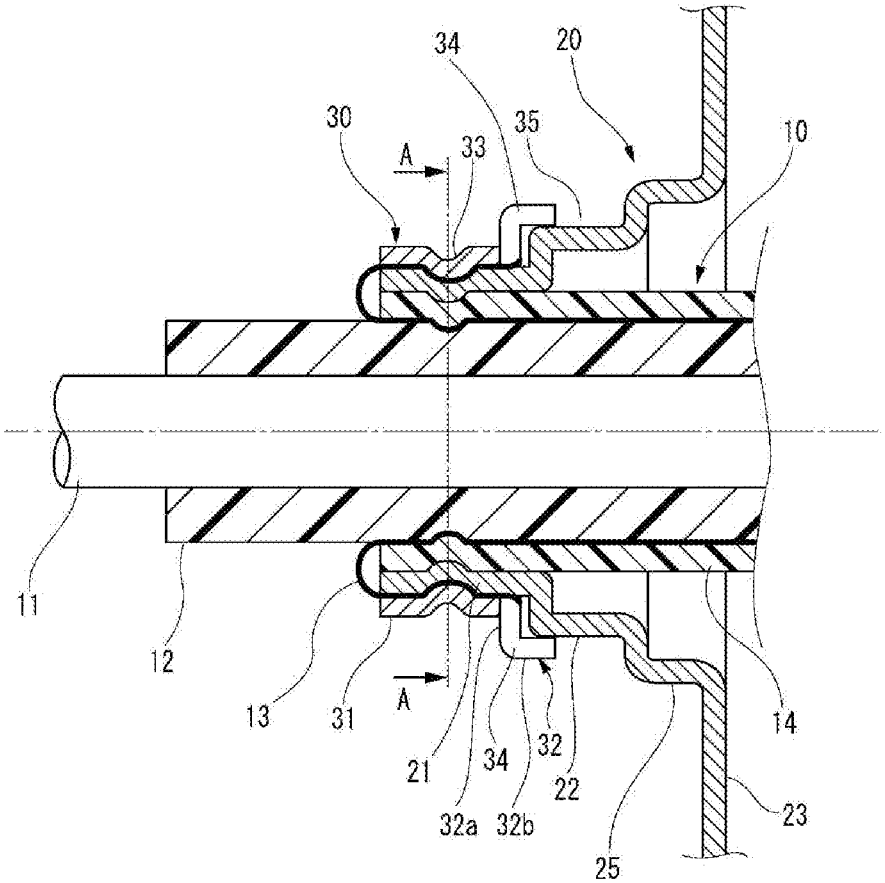
FIG. 2 is a cross-sectional view taken along an axis of the electric wire to which the terminal is crimped for explaining the terminal crimping structure according to the embodiment.
Figure 3:
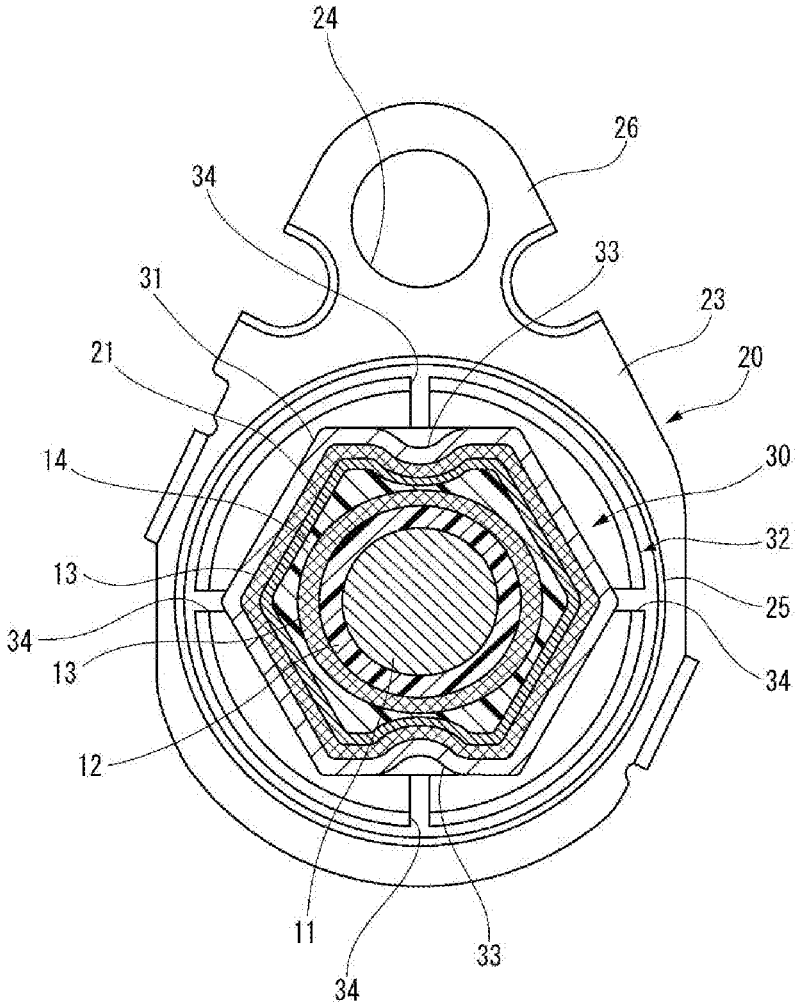
FIG. 3 is a cross-sectional view taken along line A-A in FIG. 2.

FIG. 1 is a perspective view of an end portion of an electric wire to which a terminal is crimped for explaining a terminal crimping structure according to an embodiment. FIG. 2 is a cross-sectional view taken along an axis of the electric wire to which the terminal is crimped for explaining the terminal crimping structure according to the embodiment. FIG. 3 is a cross-sectional view taken along line A-A in FIG. 2.

As illustrated in FIGS. 1 to 3, the crimping structure according to the embodiment is a structure in which a terminal 20 is crimped and fixed to an electric wire 10. The terminal 20 is provided with a fixing member 30 and is crimped and fixed to the electric wire 10 through the fixing member 30.

The electric wire 10 is a shield electric wire formed of a coaxial cable including a central conductor 11, an insulator 12, a shield conductor 13, and a sheath 14. The central conductor 11 is formed of, for example, a stranded wire formed by stranding element wires of copper or a copper alloy. The insulator 12 is formed of a resin material having insulating properties and is provided to cover the periphery of the central conductor 11. The shield conductor 13 is, for example, a braid formed by braiding element wires of copper or a copper alloy and is provided to cover the periphery of the insulator 12. The sheath 14 is formed of a resin material having insulating properties and is provided to cover the periphery of the shield conductor 13.

At an end portion of the electric wire 10, the central conductor 11 and the shield conductor 13 are exposed. The terminal 20 is mounted on an end portion of the sheath 14. In the portion where the terminal 20 is mounted, the shield conductor 13 exposed from the sheath 14 is folded back and covered. On the portion where the shield conductor 13 is folded back and covered, the fixing member 30 is mounted. The fixing member 30 is mounted from a distal end side of the electric wire 10.

The terminal 20 is a shield terminal to be electrically connected to the shield conductor 13 of the electric wire 10. For example, the terminal 20 is formed by pressing a conductive metal plate of copper, a copper alloy, or the like, and includes a crimp cylinder portion 21, a large diameter cylinder portion 22, a step portion 25, and a plate-like portion 23. The crimp cylinder portion 21 is fixed to the end portion of the inserted electric wire 10. The large diameter cylinder portion 22 is formed to have a larger diameter than the crimp cylinder portion 21 and is provided on the rear end side of the crimp cylinder portion 21. The step portion 25 is formed to have a larger diameter than the large diameter cylinder portion 22 and is provided on the rear end side of the large diameter cylinder portion 22. The plate-like portion 23 protrudes outward in a radial direction on the rear end side of the step portion 25. The plate-like portion 23 is provided with a fixing plate portion 26 provided with an insertion hole 24 at a part thereof.

For example, the fixing member 30 is formed by pressing a conductive metal plate of copper, a copper alloy, or the like and includes a fixing cylinder portion 31 and a flange portion 32. The fixing cylinder portion 31 is fixed to the crimp cylinder portion 21 of the terminal 20 covered by the shield conductor 13.

Figure 4:
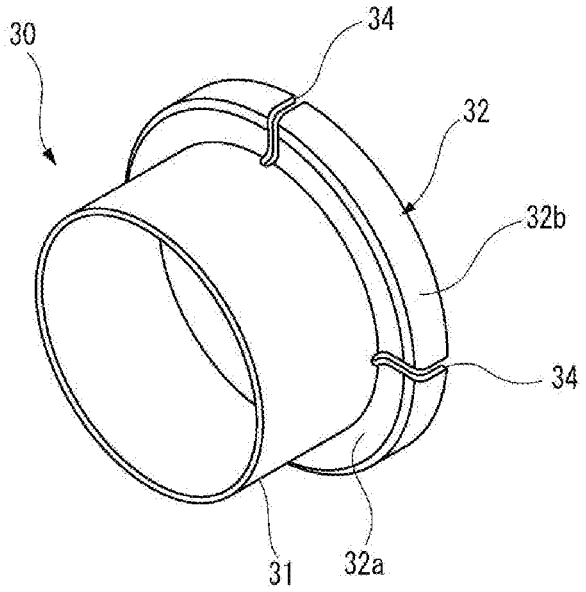
FIG. 4 is a perspective view of a fixing member.

FIG. 4 is a perspective view of the fixing member. As illustrated in FIG. 4, in the fixing member 30 before caulking, the fixing cylinder portion 31 is formed in a cylindrical shape. The flange portion 32 extends outward in the radial direction from the cylindrically formed fixing cylinder portion 31, and includes a flange plate portion 32*a* and an engaging cylinder portion 32*b* extending from an outer edge of the flange plate portion 32*a* to the rear end side. In the flange plate portion 32*a* and the engaging cylinder portion 32*b* included in the flange portion 32, notches 34 each formed of a slit extending along the radial direction are formed at a plurality of positions in the circumferential direction. In the present example, the flange portions 32 are formed at equal intervals at four positions in the circumferential direction.

The engaging cylinder portion 32*b* of the flange portion is formed to have a larger diameter than the fixing cylinder portion 31, and is fitted to the large diameter cylinder portion 22 of the terminal 20 from the distal end side. Thus, in the large diameter cylinder portion 22, an annular recess portion 35 is formed on the outer periphery thereof from the step portion 25 and the flange portion 32 of the fixing member 30. In the annular recess portion 35, a seal member (not illustrated) formed in an annular shape is accommodated.

The fixing cylinder portion 31 of the fixing member 30 is caulked together with the crimp cylinder portion 21 of the terminal 20 to have a hexagonal cross section. Thus, in the portion of the sheath 14 at the end portion of the electric wire 10, the crimp cylinder portion 21 of the terminal 20, the shield conductor 13, and the fixing cylinder portion 31 of the fixing member 30 are crimped and fixed. In the fixing cylinder portion 31 of the fixing member 30 caulked to have a hexagonal cross section, crimp recess portions 33 are formed on two opposite surfaces of the six surfaces.

The crimp recess portion 33 is formed in a planar circular shape. In the crimp recess portion 33, the cross-sectional shape along the direction orthogonal to the axis of the electric wire 10 and the cross-sectional shape along the axis of the electric wire 10 are formed in a circular arc shape. That is, the crimp recess portion 33 is a recessed portion which is hemispherically recessed.

The terminal 20 provided at the end portion of the electric wire 10 is connected to a case formed of a conductive metal material such as an inverter, a motor, or a battery. Specifically, the terminal 20 is inserted into a mounting hole of the case, a screw inserted into the insertion hole 24 formed in the fixing plate portion 26 of the plate-like portion 23 is screwed into a screw hole of the case, and the terminal is fixed such that the terminal is electrically connected to the case.

When the terminal 20 is fixed to the case as such, the shield conductor 13 of the electric wire 10 is electrically connected to the case, and a shielding effect is obtained. Therefore, influence of external noise such as electromagnetic waves is reduced and leakage of radiation noise such as electromagnetic waves from the electric wire 10 to the outside is reduced.

Next, the crimping method of caulking and crimping the terminal 20 to the electric wire 10 will be described.

Figure 5A:
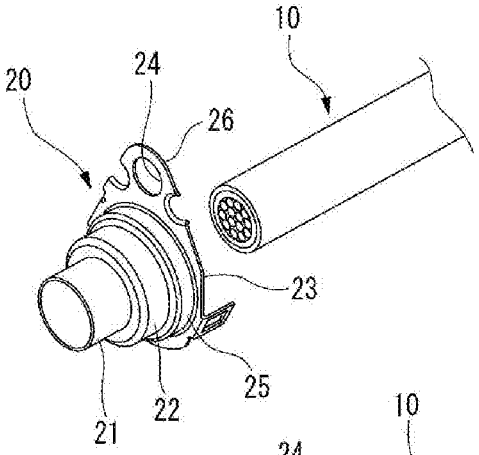
FIGS. 5A to 5C are views for explaining a procedure of crimping a terminal on an end portion of an electric wire, and are perspective views illustrating the end portion of the electric wire, respectively.
Figure 5B:
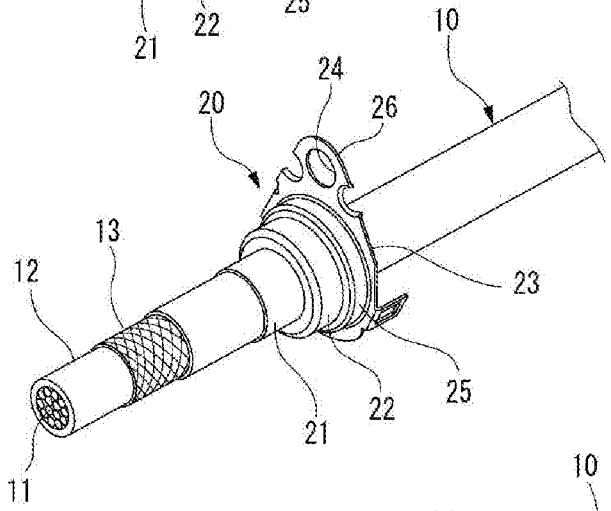
Figure 5C:
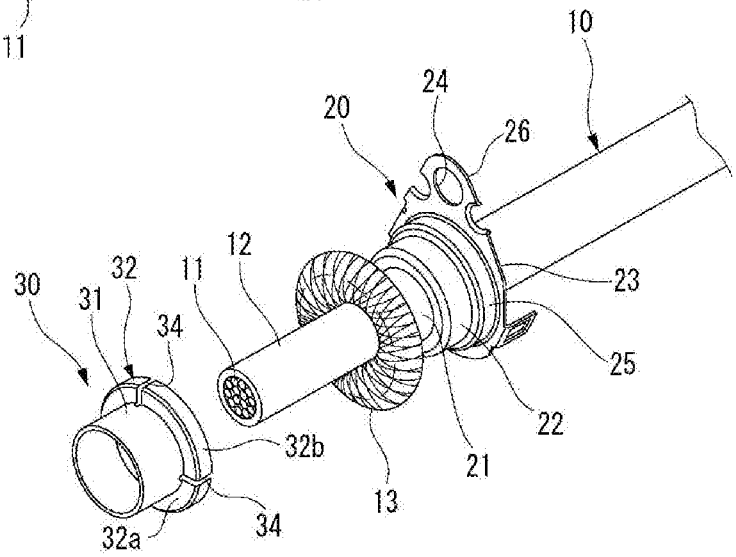
Figure 6A:
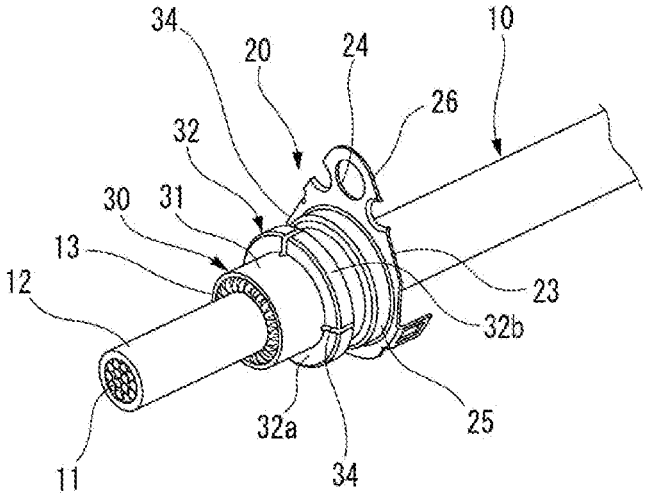
FIGS. 6A and 6B are perspective views for explaining a step of crimping a terminal to an end portion of an electric wire, and are perspective views illustrating the end portion of the electric wire, respectively.
Figure 6B:
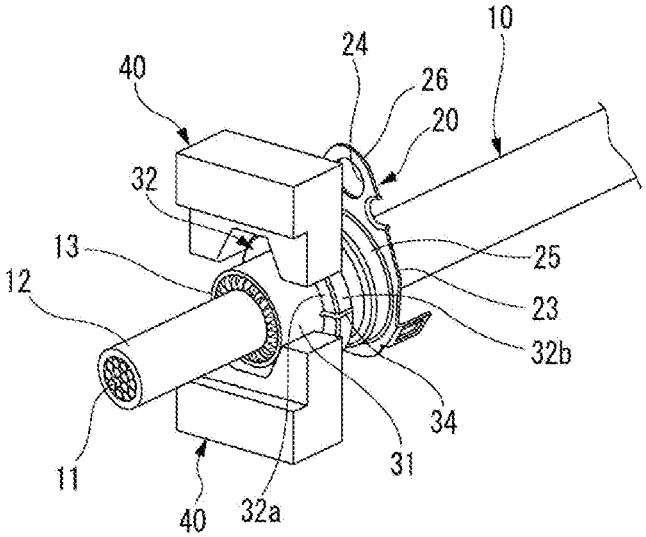
Figure 7A:
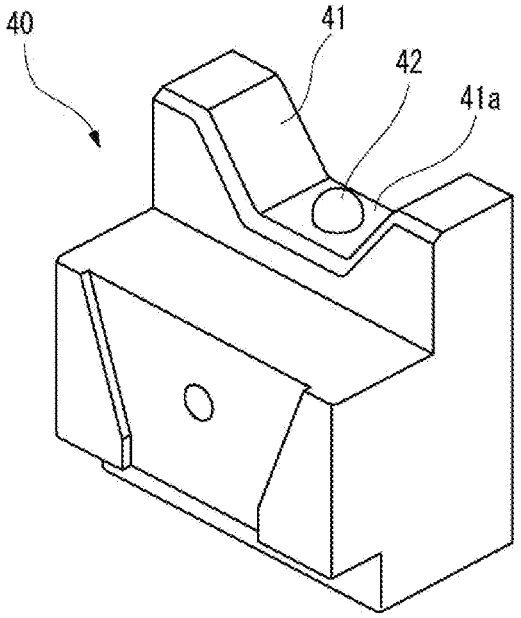
Figure 7B:
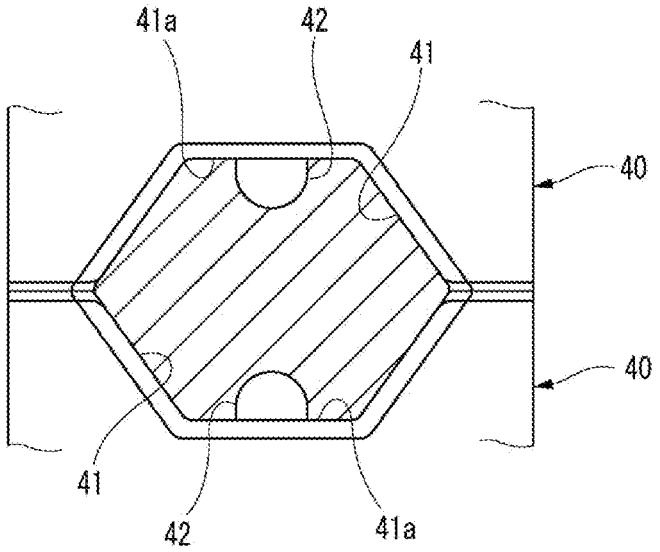

FIGS. 5A to 5C are views for explaining a procedure of crimping the terminal on the end portion of the electric wire, and FIGS. 5A to 5C are perspective views illustrating the end portion of the electric wire, respectively. FIGS. 6A and 6B are perspective views for explaining a step of crimping the terminal to the end portion of the electric wire, and FIGS. 6A and 6B are perspective views illustrating the end portion of the electric wire, respectively. FIGS. 7A and 7B are views for explaining a die for crimping the terminal to the end portion of the electric wire, FIG. 7A is a perspective view of the die, and FIG. 7B is a schematic configuration diagram of a crimping place of the electric wire by a pair of dies;

As illustrated in FIG. 5A, the end portion of the electric wire 10 is inserted into the terminal 20 in which the crimp cylinder portion 21 is formed in a cylindrical shape. As illustrated in FIG. 5B, by subjecting the electric wire 10 to a terminal treatment, the shield conductor 13 is exposed. As illustrated in FIG. 5C, the shield conductor 13 is widened and the shield conductor 13 is folded back to cover the outer periphery of the crimp cylinder portion 21 of the terminal 20.

As illustrated in FIG. 6A, the fixing member 30 in which the fixing cylinder portion 31 is formed in a cylindrical shape is inserted and fitted from the end portion of the electric wire 10 and the fixing cylinder portion 31 of the fixing member 30 is fitted to the crimp cylinder portion 21 covered with the shield conductor 13. As illustrated in FIG. 6B, the crimp cylinder portion 21 of the terminal 20 to which the fixing cylinder portion 31 of the fixing member 30 is fitted is crimped by abutting a pair of dies 40.

As illustrated in FIGS. 7A and 7B, the dies 40 include trapezoidal caulking recess portions 41 formed by bisecting a hexagon on the abutting side of each other. That is, a hexagonal caulking space portion formed by the caulking recess portions 41 of each die 40 is formed by abutting the dies 40 on each other.

On a bottom portion 41*a* forming the caulking recess portion 41 of each die 40, a pressing projection 42 having a projecting dimension D1 is formed. The pressing projection 42 is formed in a planar circular shape. In the pressing projection 42, the cross-sectional shape along the direction orthogonal to the axis of the electric wire 10 and the cross-sectional shape along the axis of the electric wire 10 are formed in a circular arc shape. That is, the pressing projection 42 is a projection which hemispherically projects.

When the pair of dies 40 are abutted on each other with the crimp cylinder portion 21, to which the fixing cylinder portion 31 of the fixing member 30 is fitted, interposed therebetween, the fixing cylinder portion 31 and the crimp cylinder portion 21 are caulked by the caulking recess portions 41 of the dies 40 through the shield conductor 13 and are formed in a hexagonal shape. Thus, the terminal 20 is crimped and fixed to the end portion of the electric wire 10, the shield conductor 13 of the electric wire 10 is interposed between the crimp cylinder portion 21 of the terminal 20 and the fixing cylinder portion 31 of the fixing member 30, and thus the terminal 20 and the shield conductor 13 are electrically connected. The pressing projections 42 formed in the bottom portions 41*a* of the caulking recess portions 41 of each die 40 bite into the fixing cylinder portion 31 to form the crimp recess portions 33. Thus, the crimping force at the crimping place is increased.

Incidentally, when the terminal 20 is crimped to the electric wire 10 by the dies 40, the pressing projection 42 bites into the fixing cylinder portion 31 of the fixing member 30, the biting places of the pressing projections 42 and the peripheral portions are pulled in the pressing direction. Then, a great tensile force is generated between the fixing cylinder portion 31 of the fixing member 30 and the highly rigid flange portion 32 formed integrally with the fixing cylinder portion 31, and thus there is concern of damage such as cracking. In this manner, when damage such as cracking occurs in the component parts of the terminal 20, it becomes difficult to control the position such as the clamp height when crimping the terminal 20 with the dies 40, or the corrosion resistance is lowered, the shielding effect is reduced and the appearance is deteriorated, so that the performance and quality are deteriorated.

In contrast, according to the terminal crimping method and the terminal crimping structure according to the embodiment, since the notches 34 along the radial direction are provided in the flange portion 32, the notches 34 are deformed to be opened so that the tensile force generated while caulking is absorbed and reduced. Accordingly, it is possible to reduce damage such as cracking in the fixing cylinder portion 31, and to crimp the terminal 20 to the electronic wire 10 with high crimping force while securing good performance and quality. Thus, it is possible to reduce damage to the fixing cylinder portion 31 of the fixing member 30 and obtain a good shielding effect.

Since the notch 34 is arranged in the vicinity of the pressing projection 42 when the fixing cylinder portion 31 is caulked, it is possible to enhance an effect of reducing the tensile force generated at caulking by the notches 34 in the circumferential direction.

Since the plurality of notches 34 are provided in the flange portion 32 at intervals in the circumferential direction, it is possible to enhance an effect of reducing the tensile force generated at caulking by the notches 34 in the circumferential direction.

Incidentally, the invention is not limited to the above-described embodiment and suitable modifications, improvements or the like can be made. The material, shape, dimension, number and arrangement of each component in the above-described embodiment are not limited but can be arbitrarily set, as long as they can achieve the invention.

For example, in the above-described embodiment, when the shield conductor 13 of the electric wire 10 formed of a shielded cable is folded back and is disposed between the crimp cylinder portion 21 and the fixing cylinder portion 31 of the fixing member 30, the fixing cylinder portion 31 is caulked. However, the embodiment is not limited to a case of crimping without using the fixing member 30. Specifically, in the invention, a case where a terminal including a fixing cylinder portion is mounted to a conductor exposed at an end portion of an electric wire covering the conductor with a sheath and the fixing cylinder portion of the terminal is caulked and crimped can be applied.

Here, the features of the terminal crimping method and the terminal crimping structure of the terminal according to the invention described above are briefly summarized in the following [1] to [8], respectively.

[1] A terminal crimping method comprising:

covering an end portion of an electric wire (10) with a fixing cylinder portion (31) of a terminal (20) including a flange portion (32) which protrudes toward an outer periphery and which has at least one notch (34) along a radial direction;

caulking and crimping the fixing cylinder portion (31) by a pair of dies (40) including pressing projections (42); and caulking the fixing cylinder portion (31) by the pressing projections (42) to form crimp recess portions (33), in the caulking and crimping the fixing cylinder portion (31).

[2] The terminal crimping method according to [1], further comprising, disposing the notch (34) in a vicinity of the pressing projection (42).

[3] The terminal crimping method according to [1] or [2], wherein the flange portion (32) includes a plurality of the notches (34) which are positioned with intervals in a circumferential direction of the flange portion (32).

[4] The terminal crimping method according to any one of [1] to [3], wherein the electric wire (10) includes a shield conductor (13) formed of a braid, wherein the terminal (20) includes a crimp cylinder portion (21) through which the electric wire (10) is inserted, and a fixing member (30) having the fixing cylinder portion (31), and wherein the fixing cylinder portion (31) is caulked by the dies (40), in a state that the shield conductor (13) which is folded back is disposed between the crimp cylinder portion (21) and the fixing cylinder portion (31) of the fixing member (30).

[5] A terminal crimping structure comprising:

an electric wire (10); and a terminal (20), wherein the terminal (20) includes a fixing cylinder portion (31) of the terminal (20) including a flange portion (32) which protrudes toward an outer periphery and which covers an end portion of the electric wire (10), wherein the fixing cylinder portion (31) is caulked and crimped, wherein the flange portion (32) has at least one notch (34) along a radial direction, and wherein crimp recess portions (33) are formed in the fixing cylinder portion (31) which is calked.

[6] The terminal crimping structure according to [5], wherein the crimp recess portion (33) is formed in a vicinity of the notch (34).

[7] The terminal crimping structure according to [5] or [6], wherein the flange portion (32) includes a plurality of the notches (34) which are positioned with intervals in a circumferential direction of the flange portion (32).

[8] The terminal crimping structure according to any one of [5] to [7], wherein the electric wire (10) includes a shield conductor (13) formed of a braid, wherein the terminal (20) includes a crimp cylinder portion (21) through which the electric wire (10) is inserted, and a fixing member (30) having the fixing cylinder portion (31), and wherein the fixing cylinder portion (31) is caulked, in a state that the shield conductor (13) which is folded back is disposed between the crimp cylinder portion (21) and the fixing cylinder portion (31) of the fixing member (30).

DESCRIPTION OF REFERENCE NUMERALS AND SIGNS

10: electric wire
13: shield conductor
21: crimp cylinder portion
30: fixing member
31: fixing cylinder portion
32: flange portion
33: crimp recess portion
34: notch
40: die
42: pressing projection

What is claimed is:

1. A terminal crimping method comprising:

covering an end portion of an electric wire with a fixing cylinder portion of a terminal including a flange portion, with an outer edge, which protrudes toward an outer periphery and which has at least one notch along a radial direction;

caulking and crimping the fixing cylinder portion by a pair of dies including pressing projections; and caulking the fixing cylinder portion by the pressing projections to form crimp recess portions, in the caulking and crimping the fixing cylinder portion, wherein the notch extends from the fixing cylinder portion to the outer edge of the flange portion, wherein the flange portion comprises:

a flange plate portion; and an engaging cylinder portion extending from an outer edge of the flange plate portion to a rear end side, and wherein the at least one notch is formed in the flange plate portion and the engaging cylinder portion.

2. The terminal crimping method according to claim 1, further comprising, disposing the notch in a vicinity of the pressing projection.

3. The terminal crimping method according to claim 1, wherein the at least one notch includes a plurality of notches positioned with intervals in a circumferential direction of the flange portion.

4. The terminal crimping method according to claim 1, wherein the electric wire includes a shield conductor formed of a braid, wherein the terminal includes a crimp cylinder portion through which the electric wire is inserted, and a fixing member having the fixing cylinder portion, and wherein the fixing cylinder portion is caulked by the dies, in a state that the shield conductor which is folded back is disposed between the crimp cylinder portion and the fixing cylinder portion of the fixing member.

5. The terminal crimping method according to claim 1, wherein the flange plate portion has an annular shape and extends outward in the radial direction from the fixing cylinder portion, wherein the at least one notch has a slit extending along the radial direction and being continuous from an extended end of the engaging cylinder portion to an inner edge of the flange plate portion.

6. A terminal crimping structure comprising:

an electric wire; and a terminal, wherein the terminal includes a fixing cylinder portion of the terminal including a flange portion, with an outer edge, which protrudes toward an outer periphery and which covers an end portion of the electric wire, wherein the fixing cylinder portion is caulked and crimped, wherein the flange portion has at least one notch along a radial direction, wherein crimp recess portions are formed in the fixing cylinder portion which is caulked, wherein the notch extends from the fixing cylinder portion to the outer edge of the flange portion, wherein the flange portion comprises:

a flange plate portion; and an engaging cylinder portion extending from an outer edge of the flange plate portion to a rear end side, and wherein the at least one notch is formed in the flange plate portion and the engaging cylinder portion.

7. The terminal crimping structure according to claim 6, wherein the crimp recess portion is formed in a vicinity of the notch.

8. The terminal crimping structure according to claim 6, wherein the at least one notch includes a plurality of notches positioned with intervals in a circumferential direction of the flange portion.

9. The terminal crimping structure according to claim 6, wherein the electric wire includes a shield conductor formed of a braid, wherein the terminal includes a crimp cylinder portion through which the electric wire is inserted, and a fixing member having the fixing cylinder portion, and wherein the fixing cylinder portion is caulked, in a state that the shield conductor which is folded back is disposed between the crimp cylinder portion and the fixing cylinder portion of the fixing member.

10. The terminal crimping structure according to claim 6, wherein the flange plate portion has an annular shape and extends outward in the radial direction from the fixing cylinder portion, wherein the at least one notch has a slit extending along the radial direction and being continuous from an extended end of the engaging cylinder portion to an inner edge of the flange plate portion.

* * * * *